US012757934B2

(12) United States Patent
Jung et al.

(10) Patent No.: US 12,757,934 B2
(45) Date of Patent: Oct. 13, 2026

(54) NICOTINE INHALER WITH FIRST AND SECOND LIQUID STORAGE PARTS

(71) Applicant: KT&G CORPORATION, Daejeon (KR)

(72) Inventors: Yong Mi Jung, Daejeon (KR); Eun Mi Jeoung, Daejeon (KR); Jun Won Shin, Daejeon (KR); Mi Jeong Lee, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 617 days.

(21) Appl. No.: 17/927,594

(22) PCT Filed: Jun. 23, 2022

(86) PCT No.: PCT/KR2022/008915

§ 371 (c)(1),
(2) Date: Feb. 9, 2023

(87) PCT Pub. No.: WO2023/013880

PCT Pub. Date: Feb. 9, 2023

(65) Prior Publication Data

US 2024/0225101 A1 Jul. 11, 2024

(30) Foreign Application Priority Data

Aug. 3, 2021 (KR) ..... 10-2021-0102131

(51) Int. Cl.
*A24F 40/30* (2020.01)
*A24B 15/167* (2020.01)
(Continued)

(52) U.S. Cl.
CPC ..... *A24F 40/30* (2020.01); *A24B 15/167* (2016.11); *A24B 15/243* (2013.01); *A24F 40/10* (2020.01);
(Continued)

(58) Field of Classification Search
CPC ..... A24F 40/30; A24F 40/10; A24F 40/40; A24F 40/57; A24F 40/60; A24F 47/00
See application file for complete search history.

(56) References Cited

U.S. PATENT DOCUMENTS 10,004,259 B2 6/2018 Sebastian et al.
10,716,328 B2 7/2020 Liu et al.
(Continued)

FOREIGN PATENT DOCUMENTS

CN 203353681 U 12/2013
EP 3827676 A1 * 6/2021 ..... A24F 40/30
(Continued)

OTHER PUBLICATIONS

Translation of WO 2017/075827 A1 (Year: 2017).*
(Continued)

*Primary Examiner* — Michael H. Wilson
*Assistant Examiner* — Michael Patrick Mullen
(74) *Attorney, Agent, or Firm* — Sughrue Mion, PLLC

(57) ABSTRACT

The present invention relates to a nicotine inhaler including: a body including a tube-shaped housing; a first liquid storage part including liquid nicotine; a second liquid storage part including a smoke generating liquid; a heating element generating smoke by heating the smoke generating liquid; and a switch disposed on the outer surface of the body.

8 Claims, 3 Drawing Sheets

(51) Int. Cl.

| | |
|---|---|
| ***A24B 15/24*** | (2006.01) |
| ***A24F 40/10*** | (2020.01) |
| ***A24F 40/42*** | (2020.01) |
| ***A24F 40/44*** | (2020.01) |
| ***A24F 40/46*** | (2020.01) |
| ***A24F 40/485*** | (2020.01) |
| ***A24F 40/57*** | (2020.01) |
| ***A24F 40/60*** | (2020.01) |

(52) U.S. Cl.
CPC ..... *A24F 40/42* (2020.01); *A24F 40/44* (2020.01); *A24F 40/46* (2020.01); *A24F 40/485* (2020.01); *A24F 40/57* (2020.01); *A24F 40/60* (2020.01)

(56) References Cited

U.S. PATENT DOCUMENTS

| | | | | |
|---|---|---|---|---|
| 2014/0270727 | A1 | 9/2014 | Ampolini et al. | |
| 2015/0351456 | A1* | 12/2015 | Johnson | A24F 40/30 131/329 |
| 2018/0014574 | A1 | 1/2018 | Rogan | |
| 2018/0027876 | A1 | 2/2018 | Watson et al. | |
| 2018/0160734 | A1 | 6/2018 | Batista et al. | |
| 2018/0235280 | A1 | 8/2018 | Biel et al. | |
| 2018/0325176 | A1* | 11/2018 | Burseg | A24F 40/30 |
| 2019/0008212 | A1 | 1/2019 | Atkins et al. | |
| 2020/0164162 | A1* | 5/2020 | Phillips | A61M 15/06 |
| 2020/0359694 | A1 | 11/2020 | Kane et al. | |
| 2021/0068455 | A1 | 3/2021 | Jones et al. | |
| 2021/0169148 | A1 | 6/2021 | Nakano et al. | |
| 2021/0345678 | A1 | 11/2021 | Macko | |
| 2022/0001119 | A1 | 1/2022 | Woods et al. | |
| 2022/0040422 | A1 | 2/2022 | Buchberger | |

FOREIGN PATENT DOCUMENTS

| | | | | |
|---|---|---|---|---|
| JP | 2020-072742 | A | 5/2020 | |
| JP | 2020-127413 | A | 8/2020 | |
| KR | 102016848 | B1 | 8/2019 | |
| KR | 10-2020-0057712 | A | 5/2020 | |
| RU | 2647805 | C2 | 3/2018 | |
| TW | 202008900 | A | 3/2020 | |
| WO | WO-2017075827 | A1 * | 5/2017 | A24F 47/00 |
| WO | WO-2021071220 | A1 * | 4/2021 | A24F 40/51 |

OTHER PUBLICATIONS

Office Action issued Apr. 17, 2023 in Korean Application No. 10-2021-0102131.

Extended European Search Report issued Nov. 8, 2023 in Application No. 22801947.7.

Communication dated Sep. 20, 2024 in Russian application No. 2022129655/03.

International Search Report of PCT/KR2022/008915 dated Nov. 7, 2022 [PCT/ISA/210].

* cited by examiner

【Figure 1】
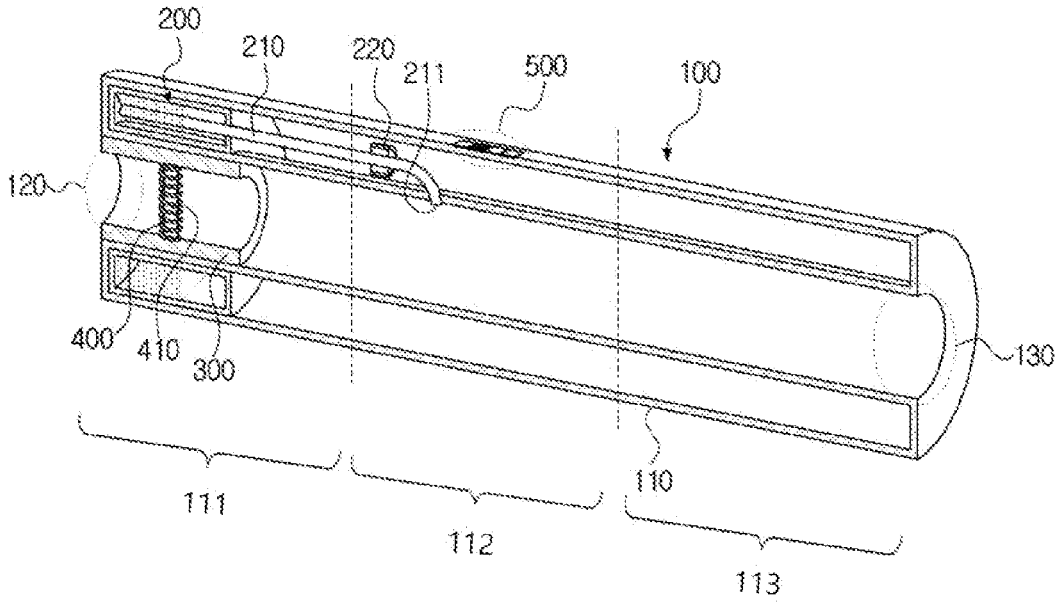

【Figure 2】
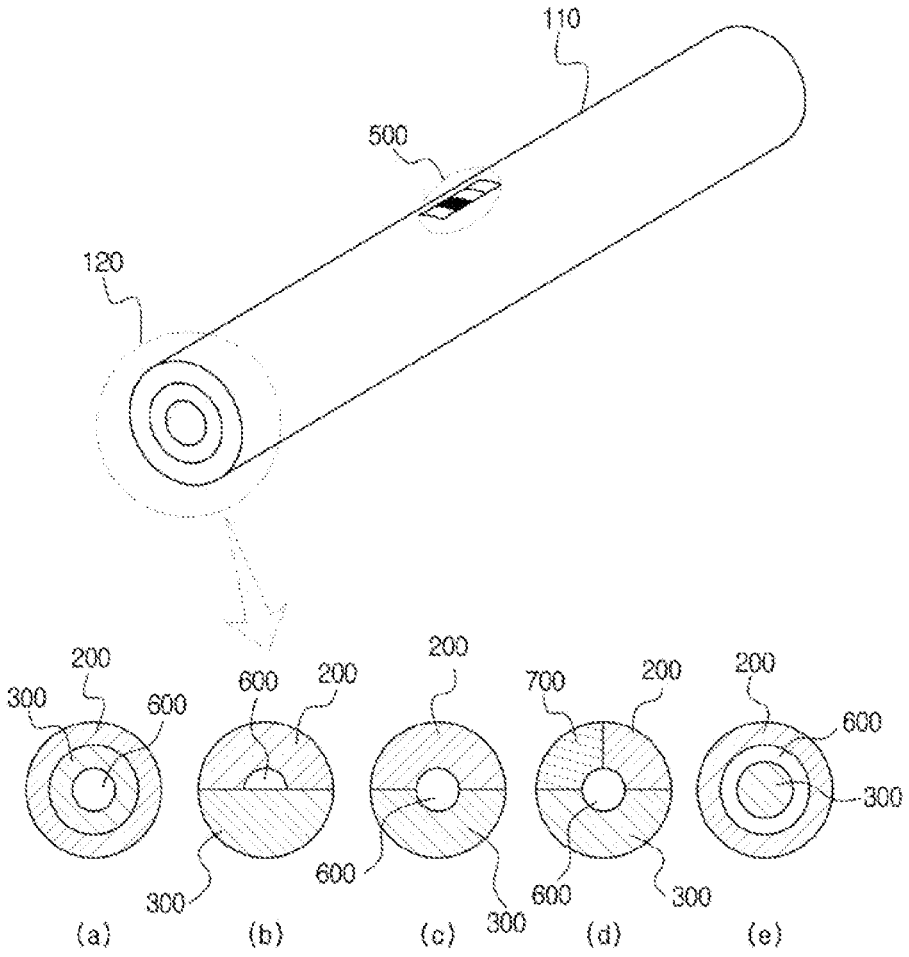

【Figure 3】
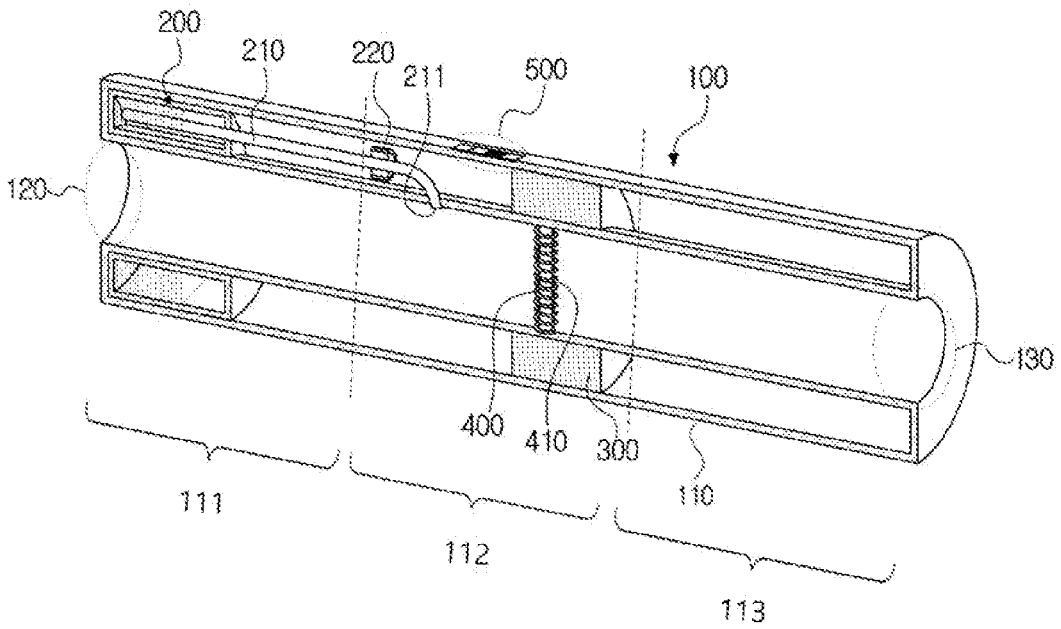

NICOTINE INHALER WITH FIRST AND SECOND LIQUID STORAGE PARTS

CROSS REFERENCE TO RELATED APPLICATIONS

This application is a National Stage of International Application No. PCT/KR2022/008915, filed Jun. 23, 2022, claiming priority to Korean Patent Application No. 10-2021-0102131, filed Aug. 3, 2021.

TECHNICAL FIELD

The present invention relates to a nicotine inhaler, specifically, a nicotine inhaler that can adjust smoky and smokeless modes.

BACKGROUND ART

A method of delivering nicotine to the lungs in an aerosol type through an inhaler is an attractive means for delivering nicotine. In this case, the size of the aerosol is a very important factor for satisfaction of smoking. This is because when aerosol of large particles is inhaled, large drops hit against the occiput or the respiratory tract, thereby transmitting a negative feeling. That is, the smaller the particle size of nicotine aerosol, the more the nicotine is smoothly inhaled and the deeper the nicotine permeates into the lungs, whereby satisfaction of smokers can be improved.

In addition to the particle size of nicotine aerosol, as a factor that determines satisfaction of smokers who use an inhaler, whether an abundant amount of visible smoke is generated may be one of important factors that determine satisfaction of smokers, depending on smokers, in that common inhalers supply a predetermined amount of liquid nicotine through each puff and generate invisible aerosol when the smoker inhales and exhales.

However, conventional nicotine inhalers give the smokers a feeling of satisfaction by nicotine supplied in a predetermined amount through liquid-state aerosol, but do not generate an abundant amount of smoke that can be visually seen or cannot adjust the amount of smoke, so smokers have pointed out that satisfaction of smoking is low.

In order to solve this problem, it is required to research and develop a nicotine inhaler that enables the smokers to adjust an abundant amount of smoke that can be visually seen in person.

PRIOR ART DOCUMENT

Patent Document (Patent Document 1) U.S. Patent Publication No. 10004259, "Reservoir and heater system for controllable delivery of multiple aerosolizable materials in an electronic smoking article"

DISCLOSURE

Technical Problem

In order to solve the above problems, it is an object of the present invention to provide a nicotine inhaler that enables a smoker to easily select smoky and smokeless modes according to his/her preference and adjust the amount of smoke in person.

Technical Solution

According to a 'first aspect' of the present invention, there is provided a nicotine inhaler including: a body including a tube-shaped housing; a first liquid storage part including liquid nicotine; a second liquid storage part including a smoke generating liquid; a heating element generating smoke by heating the smoke generating liquid; and a switch disposed on the outer surface of the body.

In an embodiment of the present invention, the housing may include: a first housing section that is a first ⅓ section from an opening positioned at one end of the housing when the housing is equally divided into three parts in the longitudinal direction; a second housing section that is adjacent to the first housing section and is a second ⅓ section from the opening; and a third housing section that is adjacent to the second housing section and is a third ⅓ section from the opening.

In an embodiment of the present invention, the first liquid storage part may be positioned in the first housing section, and may surround the inner surface of the opening.

In an embodiment of the present invention, the second liquid storage part may be positioned in the first housing section, and may be selected from a group consisting of: a type surrounding the inner surface of the first liquid storage part; a type surrounding the inner surface of the opening by ½ with the first liquid storage part, respectively; a type occupying ½ of the opening in a half cylindrical shape; and a type spaced apart toward the center of the opening from the first liquid storage part and positioned in a cylindrical shape.

In an embodiment of the present invention, the nicotine inhaler may further include: a liquid supplying tube that supplies liquid nicotine into the housing from the first liquid storage part; and a liquid injection port connected with the liquid supplying tube, and the heating element may be disposed closer to the opening than the liquid injection port.

In an embodiment of the present invention, the second liquid storage part may be positioned in the second housing section and may surround the inner surface of the second housing section.

In an embodiment of the present invention, the first liquid storage part may further include a fragrance spreader surrounding a portion of the inner surface of the opening.

In an embodiment of the present invention, the second liquid storage part may further include a liquid absorber in which the smoke generating liquid is impregnated.

In an embodiment of the present invention, the liquid absorber may include one selected from a group consisting of paper, cotton, a porous bead, and a combination thereof.

In an embodiment of the present invention, the heating element may be positioned on the surface of or inside the liquid absorber to heat the smoke generating liquid.

In an embodiment of the present invention, the switch may be a component that controls start and end of production of smoke and the amount of smoke in accordance with the preference of a smoker by adjusting step by step the amount of heat that is supplied to the heating element.

In an embodiment of the present invention, the housing may include a venturi tube therein, the venturi tube include: an inlet tube section communicating with the opening at an end of the housing; a center tube section having a liquid injection port in the inner surface; and an outlet tube section communicating with the suction port at another end of the housing, and the first liquid storage part may communicate with the liquid injection port of the center tube section through the liquid supplying tube.

In an embodiment of the present invention, the outlet tube section may have a length longer than that of the inlet tube section.

In an embodiment of the present invention, the inlet tube section may include a first tapered portion tapered toward the center tube section, the outlet tube section may include a second tapered portion tapered toward the center tube section, and the angle made by the first tapered section and the center axis of the venturi tube may be larger than the angle made by the second tapered section and the center axis of the venturi tube.

Advantageous Effects

The nicotine inhaler according to the present invention includes a cartridge that generates visible smoke and has a switching function enabling operation in smoky and smokeless modes, thereby having an effect that it is possible to select smoky and smokeless modes and adjust the amount of smoke in accordance with the preference of a smoker.

In the nicotine inhaler according to the present invention, since the storage part including the smoke generating liquid is disposed in the housing in various ways, there is an effect that it is possible to flexibly design the structure of an inhaler in a compact type.

BRIEF DESCRIPTION OF THE DRAWINGS

FIG. 1 is a perspective view showing a cross-section of a nicotine inhaler when a second liquid part is positioned in a first housing section in the present invention.

FIG. 2 is an enlarged view showing a cross-section of an opening of the nicotine inhaler when a second liquid part is positioned in the first housing section in the present invention.

FIG. 3 is a perspective view showing a cross-section of the nicotine inhaler when the second liquid part is positioned in a second housing section in the present invention.

BEST MODE

Hereinafter, the present invention will be described in more detail.

The terms and words used in the present specification and claims should not be construed as being limited to ordinary or dictionary meaning, but should be construed as having meanings and concepts consistent with the technical idea of the present invention, based on the principle that the inventor can properly define the concept of a term to describe her/his invention in the best way possible.

The terminology used herein is only for the purpose of describing particular embodiments rather than limiting the present invention. The singular forms include plural referents unless the context clearly dictate otherwise. It is to be understood that the terms "comprise" or "have" as used in the present specification, are intended to designate the presence of stated features, numbers, steps, operations, components, parts or combinations thereof, but not to preclude the possibility of the presence or addition of one or more other features, numbers, steps, operations, components, parts, or combinations thereof.

The terms 'front' and 'rear' as used herein are defined on the basis of flow of aerosol.

Hereafter, the embodiments of the present invention will be described in detail with reference to the accompanying drawings such that those skilled in the art can easily implement the present invention. However, the present invention may be embodied in various different forms, and is not limited to the embodiments described herein.

The embodiments of the present invention will be described hereafter in detail with reference to the drawings.

Since the conventional nicotine inhaler generates aerosol when supplying a predetermined amount of liquid nicotine to each puff or generates only invisible aerosol when the smoker inhales or exhales, it has been pointed out as a problem that it is difficult for the smoker to feel the satisfaction of smoking from an abundant amount of visible smoke.

In order to solve this problem, the present inventors have ended up to invent a nicotine inhaler that supplies a predetermined amount of liquid nicotine, and that enables the smoker to select whether to generate visible smoke and also adjust the amount of smoke in person, depending on the preferences of the smoker.

In an embodiment of the present invention, a nicotine inhaler includes; a body 100 including a tube-shaped housing; a first liquid storage part 200 including liquid nicotine; a second liquid storage part 300 including a smoke generating liquid; a heating element 400 generating smoke by heating the smoke generating liquid; and a switch 500 disposed on the outer surface of the body.

In an embodiment of the present invention, as shown in FIGS. 1 and 3, the nicotine inhaler includes a body 100 including a tube-shaped housing 110. The housing 110, as shown in FIG. 1, may have a tubular structure, in which an opening 120 is positioned at one end and a suction port 130 at the other end, and an air channel is formed therein.

In an embodiment of the present invention, as shown in FIGS. 1 and 3, the housing 110 may include: a first housing section 111 that is a first ⅓ section from the opening 120 positioned at one end of the housing 110 when the housing 110 is equally divided into three parts in the longitudinal direction; a second housing section 112 that is adjacent to the first housing section 111 and is a second ⅓ section from the opening 120; and a third housing section 123 that is adjacent to the second housing section 112 and is a third ⅓ section from the opening 120. The first housing section 111 may include the opening 120 through which air is introduced, the second housing section 112 may include the air channel in the housing 110 through which the introduced aerosol moves toward the suction port 130, and the third housing section 113 may include the suction port 130 through which aerosol is suctioned to a smoker.

In an embodiment of the present invention, as shown in FIGS. 1 and 3, the nicotine inhaler includes a first liquid storage part 200 including liquid nicotine. The liquid nicotine may further include a propellant together with a nicotine solution and the propellant may be one publicly known in the art.

In an embodiment of the present invention, as shown in FIGS. 1 and 3, the first liquid storage part 200 may be positioned inside the first housing section 111, and may surround the inner surface of the opening 120. Specifically, the first liquid storage part 200 may surround the entire inner surface of the opening 120, may surround ½ of the inner surface of the opening 120, may surround ⅓ of the inner surface of the opening 120, may surround ¼ of the inner surface of the opening 120, or may surround ⅕ of the inner surface of the opening 120, but is not limited particularly thereto as long as it can supply a predetermined amount of nicotine by discharging liquid nicotine to a liquid injection port 211 through a liquid supplying tube 210.

In an embodiment of the present invention, as shown in FIG. 2*d*, the first liquid storage part 200 may further include a fragrance spreader 700 surrounding a portion of the inner surface of the opening 120. The fragrance spreader 700 can help a user inhale inflow air added with a fragrance. The fragrance spreader 700, for example, may include a solid incense, an incense included in a porous material, an aromatic sheet, a fragrance capsule, etc.

In an embodiment of the present invention, as shown in FIGS. 1 and 3, the nicotine inhaler includes a second liquid storage part 300 including a smoke generating liquid. The smoke generating liquid, which is a liquid that is vaporized to generate visible smoke, may be selected from a group consisting of glycerin, propylene glycol, ethylene glycol, dipropylene glycol, diethylene glycol, triethylene glycol, tetraethylene glycol, oleyl alcohol and a combination thereof, and preferably, may be selected from a group consisting of glycerin, propylene glycol and a combination thereof.

In an embodiment of the present invention, as shown in FIGS. 1 and 2, the second liquid storage part 300 is positioned in the first housing section 111, and may be selected from a group consisting of a type surrounding the inner surface of the first liquid storage part 200; a type surrounding the inner surface of the opening 120 by ½ with the first liquid storage part 200, respectively; a type occupying ½ of the opening 120 in a half cylindrical shape; and a type spaced apart toward the center of the opening 120 from the first liquid storage part 200 and placed in a cylindrical shape, preferably, may be a type surrounding the inner surface of the first liquid storage part 200; or a type occupying ½ of the opening 120 in a half cylindrical shape, and most preferably, may be a type surrounding the inner surface of the first liquid storage part 200.

In an embodiment of the present invention, as shown in FIG. 3, the second liquid storage part 300 may be positioned inside the second housing section 112 and may surround the inner surface of the second housing section 112. When the second liquid storage part 300 is positioned in the second housing section 112 defined inside the housing 110 and spaced apart from the opening 120 of the housing 110, there is an effect that it is possible to manufacture an inhaler in a compact structure flexibly using the empty space in the nicotine inhaler. Further, as compared with when the second liquid storage part 300 is positioned in the opening 120, there is an advantage that it is easy to secure a channel for air flowing into the opening 120.

In an embodiment of the present invention, as shown in FIGS. 1 and 3, the second liquid storage part 300 may further include a liquid absorber 410 in which the smoke generating liquid is impregnated.

In an embodiment of the present invention, the liquid absorber 410 may be selected from a group consisting of paper, cotton, a porous bead, and a combination thereof, but may be any one publicly known in the art as long as it can easily absorb a liquid before vaporizing the smoke generating liquid. For example, the liquid absorber may be a roll of wrinkled paper, a lump of cotton, or a wick made of a porous bead, but is not particularly limited thereto.

In an embodiment of the present invention, as shown in FIGS. 1 and 3, a heating element 400 that generates smoke by heating the smoke generating liquid is included. The heating element 400 may be a unit that applies heat to a smoke generating liquid to generate smoke. The heating element 400 may be a heat source based on a chemical reaction, a thermoelectric element, a conductive metal heating element, a ceramic heating element, or the like, but is not particularly limited thereto as long as it can apply heat. For example, the heating element 400 may be a heater including conductive metal having a straight, curved, spiral, or zigzag pattern.

In an embodiment of the present invention, the heating element 400 may be positioned on the surface of or inside the liquid absorber 410 to heat the smoke generating liquid. Whether to dispose the heating element 400 on the surface of the liquid absorber 410 or how deep the heating element 400 is in-mold in the liquid absorber 410 may be designed in accordance with whether a burnt taste is expressed or an overheating phenomenon occurs.

In an embodiment of the present invention, the nicotine inhaler further include: a liquid supplying tube 210 that supplies a liquid nicotine into the housing 110 from the first liquid storage part 200; and a liquid injection port 211 connected with the liquid supplying tube 210, and the heating element 400 may be disposed at a position closer to the opening 120 than the liquid injection port 211. When the heating element 400 generating smoke by heating the smoke generating liquid of the liquid absorber 410 is disposed closer to the opening 120 through which air is introduced than the liquid injection port 211, there is an effect that contact with air increases, so more smoke can be generated and the user can conveniently replace a cartridge.

In an embodiment of the present invention, as shown in FIGS. 1 and 3, a crimping unit 220 that closes the liquid supplying tube in non-inhaling and opens the liquid supplying tube in inhaling may be disposed on the liquid supplying tube 210. The crimping unit 220 may be a publicly known type. For example, the clamping member disclosed in Korean Patent No. 10-1734932 may be applied. In this case, in order to apply the crimping member, the structure of the nicotine inhaler of the present invention may include an additional component. For example, one suction port communicating with the space between the housing and the inner surface of the body may be further formed at the suction port, and the crimping unit 220 may further have a part that can remove the pressure that is applied to the liquid supplying tube by the crimping unit by operating in inhaling through the suction port.

In an embodiment of the present invention, as shown in FIGS. 1 to 3, the nicotine inhaler further includes a switch 500 disposed on the outer surface of the body. The switch 500, which is a component that adjusts the amount of heat that is supplied to the heating element 400, is not particularly limited in the shape and size as long as the user can easily turn on/off the switch even during smoking and can adjust the amount of smoke.

In an embodiment of the present invention, the switch 500 may be a component that controls start and end in generating smoke and the amount of smoke in accordance with the preference of the smoker by adjusting step by step the amount of heat that is supplied to the heating element 400. For example, the switch may be a button-type switch capable of selecting smoky and smokeless modes, or may be configured in a type capable of selectively adjusting the amount of smoke to be high, medium, or low even in a smoky mode by including a plurality of buttons. Further, even in one step selected through the switch, the degree of flow that is generated around the wick varies according to the inhaling amount of the user and in this case, an evaporation amount according to a convective effect also varies, so the amount of generated smoke can be adjusted.

In an embodiment of the present invention, the housing 110 includes a venturi tube therein, wherein the venturi tube includes: an inlet tube section communicating with an opening at one end of the housing; a center tube section having a liquid injection port in the inner surface; and an outlet tube section communicating with the suction port at the other end of the housing, and the first liquid storage part 200 may communicate with the liquid injection port 211 of the center tube section through the liquid supplying tube 210. When the venturi tube is included, a liquid nicotine may be quickly changed into micro-aerosol to be easily inhaled into the lungs. Specifically, a liquid nicotine may be micro-aerosolized using a pressure difference in an air channel widened again after the liquid nicotine has passed a rapidly narrowed section from a wide section.

In an embodiment of the present invention, the outlet tube section may have a length longer than that of the inlet tube section. Since aerosol is further atomized while flying, it is preferable that the outlet tube section is longer than the inlet tube section.

In an embodiment of the present invention, the inlet tube section includes a first tapered portion tapered toward the center tube section, the outlet tube section includes a second tapered portion tapered toward the center tube section, and an angle made by the first tapered portion and the center axis of the venturi tube may be larger than an angle made by the second tapered portion and the center axis of the venturi tube. Since the first tapered portion is connected with the opening through which air is introduced, a wide channel for inflow of air is secured, and the angle made by the first tapered portion and the center axis of the venturi tube may be formed to be larger than the angle made by the second tapered portion to satisfy that the outlet tube section is longer than the inlet tube section.

The nicotine inhaler of the present invention can provide an advantage that it is possible to select smoky/smokeless modes and adjust the amount of smoke according to the preference of the user while supplying a predetermined amount of nicotine, and to design the first liquid storage part storing liquid nicotine and the second liquid storage part storing a smoke generating liquid in various structures while securing a channel for air.

Although the present invention was described with reference to preferable embodiments described above, it may be changed or modified in various ways without departing from the gist and scope of the present invention. Therefore, the scope of the appended claims may include such changes and modifications pertaining to the gist of the present invention.

DESCRIPTION OF REFERENCE NUMERAL

100: body
110: housing
111: first housing section
112: second housing section
113: third housing section
120: opening
130: suction port
200: first liquid storage part
210: liquid supplying tube
211: liquid injection port
220: crimping unit
300: second liquid storage part
400: heating element
410: liquid absorber
500: switch
600: air channel
700: fragrance spreader

The invention claimed is:

1. A nicotine inhaler comprising:

a body including a tube-shaped housing and an opening at one end of the housing, the opening comprising an inner surface, wherein the body extends in a longitudinal direction;

a first liquid storage part including liquid nicotine and surrounding the inner surface of the opening at the one end of the housing;

a second liquid storage part including a smoke generating liquid, the second liquid storage part surrounding an inner surface of the housing and spaced apart from the first liquid storage part in the longitudinal direction;

a liquid supply tube extending from inside the first liquid storage part toward the second liquid storage part in the longitudinal direction;

a liquid injection port connected to the liquid supply tube and between the first liquid storage part and the second liquid storage part, and that supplies the liquid nicotine from the first liquid storage part into the housing;

a heating element positioned closer to a suction port than the first liquid storage part and the liquid injection port, and generating smoke by heating the smoke generating liquid; and a switch disposed on an outer surface of the body.

2. The nicotine inhaler of claim 1, wherein the housing includes:

a first housing section that is a first ⅓ section from the opening;

a second housing section that is adjacent to the first housing section and is a second ⅓ section from the opening; and a third housing section that is adjacent to the second housing section and is a third ⅓ section from the opening.

3. The nicotine inhaler of claim 2, wherein the first liquid storage part is positioned in the first housing section.

4. The nicotine inhaler of claim 3, wherein the first liquid storage part further includes a fragrance spreader surrounding a portion of the inner surface of the opening.

5. The nicotine inhaler of claim 1, wherein the second liquid storage part further includes a liquid absorber in which the smoke generating liquid is impregnated.

6. The nicotine inhaler of claim 5, wherein the liquid absorber includes one selected from a group consisting of paper, cotton, porous bead, and a combination thereof.

7. The nicotine inhaler of claim 5, wherein the heating element is positioned on the surface of or inside the liquid absorber to heat the smoke generating liquid.

8. The nicotine inhaler of claim 1, wherein the switch is a component that controls start and end in generating smoke and an amount of smoke according to a preference of a smoker by adjusting step by step an amount of heat that is supplied by the heating element.

* * * * *